United States Patent [19]

Spillmann et al.

[11] 4,246,668

[45] Jan. 27, 1981

[54] TREATMENT OF A WEB OF MATERIAL

[75] Inventors: Werner Spillmann, Kilchberg; Rolf Lehmann, Rudolfstetten, both of Switzerland

[73] Assignee: Escher Wyss Limited, Zurich, Switzerland

[21] Appl. No.: 39,452

[22] Filed: May 16, 1979

[30] Foreign Application Priority Data

Jun. 9, 1978 [CH] Switzerland ..... 6307/78

[51] Int. Cl.[3] ..... D06B 11/00

[52] U.S. Cl. ..... 8/149; 8/151; 8/151.2; 68/22 R; 118/102; 118/117; 427/278

[58] Field of Search ..... 8/14, 149, 151, 151.2; 68/22 R, 244, 200, 202, 203, 205 R; 427/256, 278, 286, 288; 118/102, 115, 117; 101/172

[56] References Cited

U.S. PATENT DOCUMENTS 344,086 6/1886 Derick ..... 427/278 X 3,783,654 1/1974 Crawford ..... 8/149 X

FOREIGN PATENT DOCUMENTS 898074 4/1972 Canada ..... 427/286

*Primary Examiner*—Philip R. Coe

*Attorney, Agent, or Firm*—Robert A. Ostmann

[57] ABSTRACT

To obtain optical effects, particularly dye pattern effects, a treatment is proposed for a web of material or a number of webs of material guided side by side in the nip between treatment rollers, more particularly a web of material impregnated with or containing dye or other finishes, wherein the treatment pressure is set differently in individual longitudinal portions of the nip or is set intermittently, so that the web of material is exposed to different treatment pressures at different points, with the result that, in particular, the dye or other finish is forced out of the parts of the web of material subjected to the greatest pressure, and into those parts subjected to least pressure. An apparatus is proposed for carrying out this treatment, wherein one of the treatment rollers which form the nip is a deflection adjustment roller and comprises support members which are associated with controllable pressure regulators for regulating the pressure in the support members.

14 Claims, 9 Drawing Figures

Fig.4
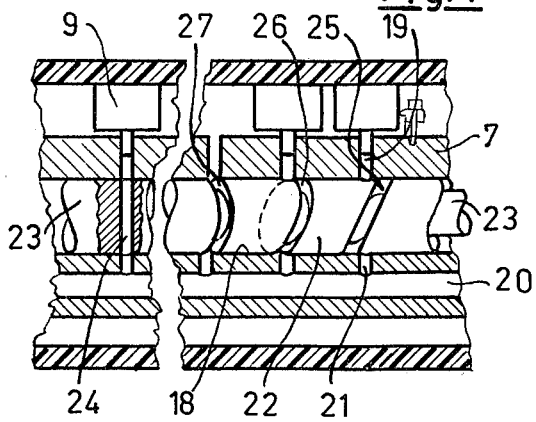
Fig. 5
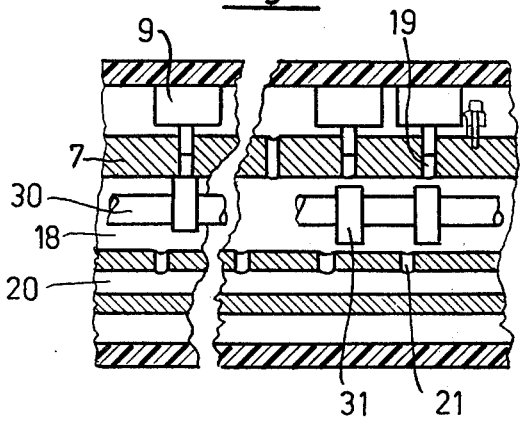
Fig.6 Fig.7
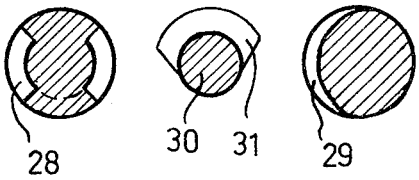
Fig.8
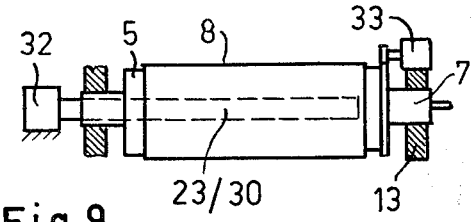
Fig.9

TREATMENT OF A WEB OF MATERIAL

BACKGROUND OF THE INVENTION

The invention relates to a treatment for a web of material or a number of webs of material guided side by side in the nip between treatment rollers, more particularly a web of material impregnated with or containing dye or other finishing agents.

Treatments of this kind are conventional in the finishing of textiles, paper or sheet metal. An example is the so-called foulard process in the dyeing of textiles. A web of textile material is passed through a bath of dye, impregnated with the dye and then treated by pressure in a nip between the treatment rollers of a squeezing press, so that the excess dye is squeezed out of the material and the desired quantity of dye is pressed into the material. This treatment produces a web of material of a uniform shade of colour.

However, there is a need, for example, for webs of textile material having a dye pattern consisting of patches of dye distributed evenly or unevenly over the width and length of the web. These patches of dye differ from one another in the brightness or shade of colour. The intention is that the transitions between the patches should gradually blur, so that the material looks washed out. When a material is treated with glazes, a similar optical effect is desired, to make the material look as though it has worn out. In the past, optical dye and glazing effects of this kind have been produced by hand treating, for example by manually washing the dye out of the material. The dye printing techniques used for obtaining optical effects of this kind would be unjustifiably expensive or simply not possible, in view of the normally considerable width of the webs of material, because of the dimensions of the pattern rollers. For the same reason, changes in design would scarcely be possible.

SUMMARY OF THE INVENTION

The aim of the invention is to produce webs of material having the abovementioned patterns or optical effects by machine, by means of a treatment of the type described at the beginning. At the same time, the invention sets out to provide an apparatus suitable for carrying out this treatment. This apparatus should also make it possible to produce different patterns with different optical effects without changing the treatment rollers, i.e the optical differences should be able to be distributed variously over the width and length of the web.

To solve this problem, it is proposed, according to the invention, that the treatment pressure be set differently in individual longitudinal portions of the nip or that this pressure be set intermittently, i.e. stopping and re-starting at intervals of time, so that the web of material is subjected to different treatment pressures at different points and so that, in particular, the dye or other finish is forced out of the parts of the web which are exposed to greater pressure, and forced into the parts exposed to less pressure.

In order to provide an apparatus designed to carry out this treatment, it is proposed according to the invention that a treatment roller which forms the nip is a deflection adjustment roller, having a fixed carrier and an elastic, more particularly an elastomeric, shell rotatable about said carrier, whilst this casing can be pressed against the other treatment roller which forms the nip by means of hydraulic support members resting on the carrier and acting towards the nip on the inner surface of the shell, the individual support members being associated with controllable pressure reulators for adjusting the pressure or intermittently regulating the pressure in the support member.

If the pressures in the support members are set at different settings, a striped pattern is obtained. If the pressure in the individual pressure members is set intermittently, a flecked pattern is obtained. The design can be varied almost infinitely. The gradual transitions sought within the pattern are achieved by means of the elastomeric shell proposed according to the invention, which absorbs the pressure from the support member and changes it elastically, not only in intensity but also in direction.

BRIEF DESCRIPTION OF THE DRAWING

The invention is hereinafter described and explained more fully with reference to drawings of exemplary embodiments of the apparatus for performing the treatment. In the drawings:

FIG. 4 is a partial longitudinal section through a deflection adjustment roller, FIG. 5 is another embodiment of the deflection adjustment roller, FIGS. 6 to 8 are examples of pressure regulators, all shown in cross section, FIG. 9 is an example of a deflection adjustment roller with drives.

DESCRIPTION OF THE PREFERED EMBODIMENTS

Figure 1:
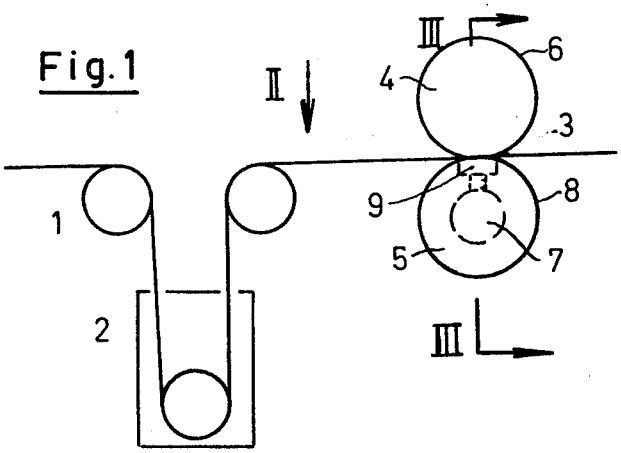
FIG. 1 shows a schematic longitudinal section through an apparatus according to the invention.

A web of material 1, e.g. a web of textile material to be dyed, is passed through a dye bath 2 and, having been impregnated with the dye, is treated in a nip 3 of a squeezing press between treatment rollers 4 and 5. It is subjected to pressure in the nip. One treatment roller 4 is a solid roller comprising an elastomeric shell 6. The second treatment roller 5 is a deflection adjustment roller. It has a fixed carrier 7 about which an elastic, elastomeric shell 8 is rotatable. This shell 8 can be pressed against the other treatment roller 4 which forms the nip 3 by means of hydraulic support members 9 resting on the carrier 7 and acting towards the nip 3 on the inner surface of the shell 8. The individual support members 9, which are arranged side by side in a row on the carrier 7 are associated with controllable pressure regulators for adjusting the pressure or for intermittently regulating the pressure in the support members 9. Thus, the pressure in individual longitudinal portions of the nip 3, corresponding geometrically to the individual support members, can be set differently or intermittently, i.e. so as to stop and start at intervals of time. Different parts of the material in the nip are thus subjected to different treatment pressures, and the dye is forced or squeezed out of the parts which are subjected to greater pressure and into the parts which are subjected to less treatment pressure. As a result, the dye shade produced by the quantity of dye taken up is lighter in the former parts and darker in the other parts. The elastomeric shell results in the washed-out transitions between the shades, as they elastically absorb the pressure exerted by the support members 9 and distributed it in the nip. If the pressure in the individual support members is different but at a constant setting in terms of time, a dye pattern of lengthwise stripes is obtained. If the pressure in the individual support members is different and also fluctuates at intervals of time, patterns are obtained with flecks distributed over the web of material. Transverse stripes are obtained by setting the pressure so as to be synchronously intermittent in all the support members.

Figure 2:
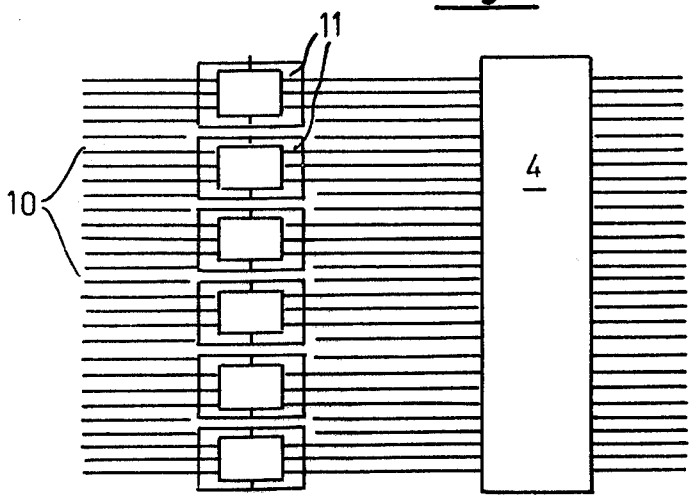
FIG. 2 shows another example of the apparatus, viewed schematically from above, in the direction of arrow II in FIG. 1.

It is also possible according to invention to treat a number of webs of material guided side by side, for example a number of warp threads 10 passing through the nip, as shown in FIG. 2. All these warp threads form a warp for subsequent weaving. The threads are subjected to different treatment pressures in the nip between treatment rollers, only the upper one 4 of which is shown in the Figure. As a result, the colour shade fluctuates in the individual threads and also in the threads lying parallel in the nip, so that the threads arranged closely side by side, as a whole, give a similar patterned image to that described above for the web of material. If a weft thread of a different colour is woven into this warp in a loom, additional optical effects are obtained. According to a variant, shown in FIG. 2, groups of threads located side by side are passed through baths 11 of different dyes which are provided side by side. During treatment in the nip, the various dyes absorbed are squeezed back and forth under the varying pressures in the nip, in both the widthways and lengthways direction of the warp, so that not only is a fluctuating colour shade obtained over the entire pattern, but also fluctuating mixtures of dyes are obtained which vary still further in shade.

Additional optical effects are possible if the above-mentioned dyeing and squeezing processes are repeated successively or combined, using other dyes or finishes.

Figure 3:
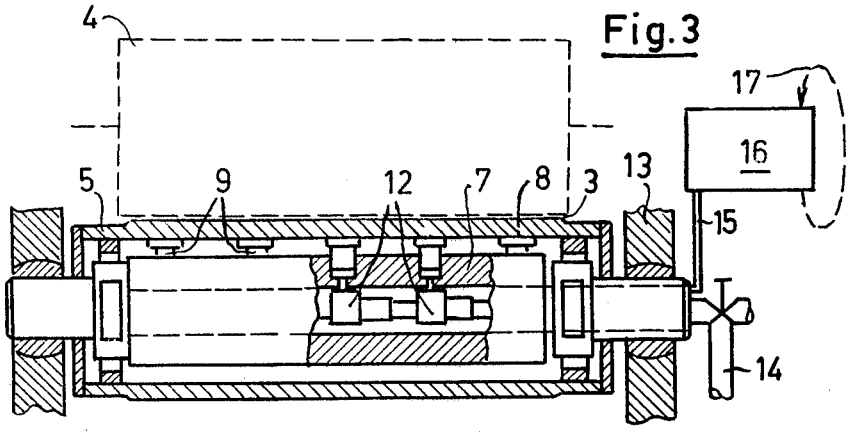
FIG. 3 is a longitudinal section through the treatment rollers along the line III-III in FIG. 1, on a larger scale.

A suitable apparatus for carrying out the treatments described is shown in FIG. 3, in particular. At least two treatment rollers of a squeezing press are provided for treating the web of material, or webs of material passing through side by side, in the nip, at different treatment pressures. One treatment roller which forms the nip is designated 4 and is a solid roller shown by dotted lines; there is no need to describe it in any more detail. It is usually provided with an elastic, preferably elastomeric covering. The other roller which forms the nip and is designated 5 is a deflection adjustment roller. It comprises a fixed carrier 7 which is nonrotatably mounted in a press stand 13. An elastomeric elastic shell 8 is mounted so as to be rotatable about this carrier and is pressed against the mating roller 4 towards the nip 3 by means of hydraulic support members 9 resting on the carrier 7. Controllable pressure regulators 12 are associated with the individual support members 9, for adjusting the pressure or intermittently regulating the pressure in the support members 9. A pressure medium is passed through a pressure medium supply duct 14 to the pressure regulators 12 and from there is passed to or into the support members. The support members used are known from earlier patents, e.g. U.S. Pat. No. 3,802,044 and therefore neither they nor their functioning and advantageous features need be described. To prevent undesirable vibrations which occur in fairly long ducts between a pressure regulator and a support member or group of support members, the pressure regulators 12 are provided in the carrier as close as possible to the support members 9. The pressure regulators are known servo valves and are remote-controlled, i.e. actuated from outside. For this purpose, lines 15 are provided, leading from impulse receivers in the servo valves to impulse generators in a control means 16. The impulses are preferably produced by the control means 16 according to a cyclic programme. Obviously, this applies only to the intermittent regulation of the pressure in the support members. The control means is also set up so as to establish different pressures in the individual support members and maintain the pressure selected.

The control system described above has certain limits of use, set, for example by the speed of operation of the servo valves or the reliability of the system in general. Sometimes, a system of this kind can be excessively complicated when a simple pattern is to be produced. Such complexity is justifiable if the apparatus is required to be highly versatile as regards producing a variety of patterns. For this reason, a simpler, purely mechanical control system for the pressure in the support members is shown in FIGS. 4 to 8. In the carrier 7 there is a longitudinal bore 18 from which conducting bores 19 lead to the individual support members. Parallel to the longidudinal bore 18 is a pressure medium supply duct 20 which is connected to the longitudinal bore 18 via bores 21. As pressure regulators provided in front of the support members, stopcocks are mounted in the longidudinal bore so as to fit rotationally therein, and these stopcocks ensure the supply of presure medium from the pressure medium supply duct 20 to the support members 9, or from the bores 21 to the conducting bores 18, i.e. depending on the position of the stopcock the flow of pressure medium between the two bores is unobstucted, throttled or stopped. Advantageously, the individual stopcocks 22 are combined to form a control roller 23 which is mounted in the longitudinal bore so as to be rotatable and longitudinally movable. It would be possible to assemble the individual stopcocks with one another, e.g. by means of a spindle extending centrally with respect to the bore. The construction of the stopcocks, particularly the construction of the passages which permit the supply of pressure medium, depends on the regulated flow desired which is to be obtained with the stopcock in question: This passage which ensures the supply of pressure medium and conducts the said medium may be a bore 24 extending transversely through the stopcock body. The bores may be located in one plane or be offset relative to one another. They could widen out conically on both sides. The stopcocks may comprise grooves extending over the periphery of the stopcock body. A groove of this kind may be arranged perpendicularly or inclined relative to the rotation axis of the stopcock body. The grooves 25, 26, 27 in FIG. 4 are positioned at an inclination relative to the rotation axis of the stopcock body. In FIGS. 6 and 8, the grooves 28 and 29, respectively, are arranged perpendicularly to the rotation axis of the stopcock body, and are cam-shaped in construction. The control effects obtainable by the direction or form of the grooves can be increased, within certain limits, by axially displacing the control roller 23 at the same time as it rotates. Another possibility arises if each transverse bore 24 is followed by a groove along the control roller, the bores being located in the same place. By axially displacing the control roller so that the supply is provided through the bores, it is possible to establish equal pressure in all the support members or to have the pressure varying intermittently, in pulse, as the shaft rotates.

Another mechanical control means for the pressure adustment roller is shown in FIG. 5. Instead of a control roller as described above, a camshaft 30 with cams 31 is mounted in rotatable and longitudinally movable manner in the longitudinal bore 18. FIG. 7 shows a section through the camshaft. As the camshaft 30 rotates, the bores 19 leading to the support members 9 are covered up or opened. To ensure an unrestricted supply of pressure medium from the pressure medium supply duct 20 to the longitudinal bore 18, the bores 21 are offset relative to the bores 19 axially with respect to the longitudinal bore 18, out of the region of the cams 31. After the camshaft 30 has been axially displaced, all the bores 19 are opened and equal pressure is established in all the support members, corresponding to the pressure of the pressure medium in the supply duct 20.

As shown in FIG. 9, the control roller 23 or the camshaft 30 is provided with its own drive 32 which is independent of the rotation of the shell 8 of the deflection adjustment roller 5. The drive is arranged to provide controllable rotation and/or displacement of the control roller 23 or camshaft 30. Thus, a shaft 23 or 30 can be moved at a frequency of n times the speed of rotation of the shell. In order that the movements of the shaft can be coordinated precisely with the revolutions of the shell 8 as required, the shell is also provided with its own independent drive by means of a regulatable motor 33. The arrangement described above, with the separate drives 32 and 33 for the control roller 23 or camshaft 30, respectively, also offers additional possible designs which can be produced with the apparatus. For this, it is assumed that the web of material is pulled through the nip by means of a winding means and the shell of the deflection adjustment roller is slowed down or intermittently slowed down relative to the speed of travel of the web, and thus as a result of this additional squeezing, the dye or other finish is squeezed even more deeply into the web than is possible using the above-mentioned actuation of the support member.

The application of the treatment hereinbefore described is by no means restricted to the foulard process in the textile industry. A batik process could be carried out, for example, using the treatment according to the invention for the wax. Clearly, it would be possible to carry out a number of treatment steps according to the invention one after the other, to obtain further multicoloured or other optical effects. It is also possible to treat materials other than textiles in this way. For example, marbling could be produced on webs of paper. A mimicry design could also be produced on sheet metal, for example.

I claim:

1. A process for producing a web of material having gradual transitions between regions of different colored effects comprising the steps of impregnating the web with a visual effect-producing agent; passing the web containing said agent through the nip of a pair of plain pressure rollers; and subjecting various portions of the web to different pressures in the nip as the web advances to thereby cause agent in web portions subjected to higher nip pressures to be squeezed out and to pass into web portions subjected to lower nip pressures.

2. A process as defined in claim 1 wherein the different pressures are established in zones distributed across the width of the nip, whereby a longitudinal stripping pattern is produced in the web leaving the nip.

3. A process as defined in claim 2 wherein the nip pressures applied to the web across its width are varied cyclically, whereby a flecked pattern is produced in the web leaving the nip.

4. A process as defined in claim 1 wherein the nip pressures applied to the web across its width are varied cyclically, whereby a transverse striping pattern is produced in the web leaving the nip.

5. A process as defined in any one of claims 1–4 wherein the web is defined by a series of threads arranged side-by-side.

6. A process as defined in claim 5 wherein different visual effect-producing agents are incorporated in adjacent threads or thread groups.

7. A process as defined in claim 1 which uses, as one of the pressure rollers, a known deflection adjustment roller comprising a fixed carrier; an elastic shell rotatable about the carrier; a series of hydraulic support members along the nip and which act between the carrier and the shell and urge the latter toward the other pressure roller; and means for controlling the pressures in the support members.

8. A process as defined in claim 7 in which said means for controlling pressures utilizes remote controlled servo valves located in the carrier; and means outside the deflection adjustment roller connected to control the servo valves.

9. A process as defined in claim 7 in which said means for controlling pressures comprises a pressure medium supply duct in the carrier; and rotatable stopcocks located in a longitudinal bore in the carrier and which are arranged to control the delivery of pressure medium from the supply duct to the support members.

10. A process as defined in claim 9 in which the stopcocks are interconnected to form a control roller which is mounted for both rotation and axial movement in said bore; and which includes means outside the deflection adjustment roller connected to move the control roller.

11. A process as defined in claim 9 or 10 in which each stopcock comprises a body containing a flow passage; and wherein each body, depending upon its position relative to the bore, establishes either free or throttled communication between an associated support member and the supply duct through said flow passage, or isolates the associated support member from the supply duct.

12. A process as defined in claim 7 in which said means for controlling pressures comprises a longitudinal bore in the carrier; a supply duct for leading pressure medium to said bore; flow passages leading from the bore to the individual support members; and a cam shaft mounted in said bore for rotary and axial movement and carrying cams which are arranged to open and close the flow passages as the cam shaft moves.

13. A process as defined in claim 7 in which the deflection adjustment roller includes an independent drive means for rotating the shell.

14. A process as defined in claim 13 in which said means for controlling pressures comprises a rotatable and longitudinally movable control element mounted in the carrier; and drive means separate from said independent drive means for moving the control element.

* * * * *